US005736212A

United States Patent [19]

Fischer

[11] Patent Number: 5,736,212

[45] Date of Patent: Apr. 7, 1998

[54] FORM WITH DETACHABLE CARD, SUPPORT AND COVERING MATERIAL THEREFOR, AND PROCESS FOR PRODUCING THE SAME

[75] Inventor: Jules Fischer, Widen, Switzerland

[73] Assignee: Folien Fischer AG, Dottikon, Switzerland

[21] Appl. No.: 525,793

[22] PCT Filed: Jan. 26, 1995

[86] PCT No.: PCT/CH95/00019

§ 371 Date: Nov. 1, 1995

§ 102(e) Date: Nov. 1, 1995

[87] PCT Pub. No.: WO95/20493

PCT Pub. Date: Aug. 3, 1995

[30] Foreign Application Priority Data

Jan. 26, 1994 [CH] Switzerland ..... 228/94

[51] Int. Cl.[6] ..... B42D 15/10

[52] U.S. Cl. ..... 428/42.2; 281/4; 281/6; 283/62; 283/75; 283/107; 428/40.1; 428/41.9; 428/42.1; 428/42.3; 428/121; 428/138; 428/914

[58] Field of Search ..... 428/40.1, 41.7, 428/41.8, 41.9, 42.1, 42.2, 42.3, 138, 121, 914; 283/75, 62, 107; 281/4, 6

[56] References Cited

U.S. PATENT DOCUMENTS

| | | | |
|---|---|---|---|
| 2,896,351 | 7/1959 | Johnson | 428/40.1 |
| 3,252,234 | 5/1966 | Goodman | 428/41.8 |
| 4,890,862 | 1/1990 | Buchholz | 283/62 |
| 5,039,652 | 8/1991 | Doll et al. | 503/206 |
| 5,271,787 | 12/1993 | Hoffmann et al. | 156/268 |
| 5,439,255 | 8/1995 | McIntire | 283/62 |
| 5,466,013 | 11/1995 | Garrison | 283/75 |

FOREIGN PATENT DOCUMENTS

| | | |
|---|---|---|
| 1274979 | 10/1909 | Canada . |
| 0613792 | 9/1994 | European Pat. Off. . |
| 2691675 | 12/1993 | France . |
| 4107469 | 9/1992 | Germany . |
| 9205036 | 4/1992 | WIPO . |

*Primary Examiner*—Nasser Ahmad

*Attorney, Agent, or Firm*—Tarolli, Sundheim, Covell Tummino & Szabo

[57] ABSTRACT

A form (1) with a detachable card (3) is disclosed. A support material (2) is glued on the back of the form and contains besides a support layer (21) a layer of glue (22) that may be peeled off the card. The card (3) is a blank held by the supporting layer (21) within the form and produced by punching (31, 32) through the front of the form up to the supporting layer (21). The card may be punched all around its periphery without leaving any punching bridges.

25 Claims, 12 Drawing Sheets

FORM WITH DETACHABLE CARD, SUPPORT AND COVERING MATERIAL THEREFOR, AND PROCESS FOR PRODUCING THE SAME

TECHNICAL FIELD

The present invention relates to a form with a detachable card and onto the back of the form, at least partly covering the area of the card, is stuck a support material, which in addition to a support layer has a glue layer which can be peeled off from the card. The term "glue layer which can be peeled off from the card" means a glue layer, which on the one hand has a permanent adhesive action with respect to the support layer, but does not evolve on the other hand a permanent adhesive action with respect to the card and from which the card can consequently be peeled without leaving glue residues thereon. An adhesive action is looked upon as being permanent if the bonded together layers cannot be easily separated from one another again in non-destructive manner.

The invention also relates to a support and a covering material for the form of the aforementioned type, as well as a production process for the same.

Forms with detachable cards are being increasingly used by organizations for calling in subscriptions and simultaneously providing a membership or identity card for the addressee.

PRIOR ART

In a known form with a detachable card the covering layers are adhered on both sides to a form sheet and the card is produced by punching through all the layers in said sheet. Punching bridges are left behind, so that the card does not drop out of the form. For the covering layers use is made of a transparent film material through which it is possible to see in the vicinity of the card an imprint on the form determining the appearance of said card. The cover layers serve to protect this imprint, obtain a smooth, water-repelling surface and for reinforcing the card.

However, the punching bridges have proved disadvantageous in the known form. They have a prejudicial optical and tactile effect on the detached card and form problem points at which there is a risk of the card being torn on detachment. Following the detachment of the card a hole is left behind in the form.

EP-A1-613792 discloses a form of the aforementioned type, in which a card produced in a separate operation following the punching out of a sufficiently large hole in the form and the back adhesion of the carrier material provided with the peel glue is inserted in the hole. Due to the production and positioning tolerances there must be a certain distance between the outer circumference of the card and the inner edges of the punched hole. The production of the card in separate operations and its positioning in the punched hole of the form sheet is relatively complicated.

DESCRIPTION OF THE INVENTION

The problem of the invention is to provide a form with a detachable card, which avoids the aforementioned disadvantages, in which however the card can be equally easily detached and up to then is at least as securely held in the form plane. The invention is also directed at providing suitable support and covering materials, as well as giving a suitable production process.

According to the invention this problem is solved in the case of a form of the aforementioned type, according to claim 1 in that the card is a blank produced by a punching performed from the front of the form and extending up to the support layer and held by the latter in the form.

Support materials are characterized in claim 9 and covering materials in claim 20. Claim 21 relates to a production process according to the invention.

Advantageous developments of the invention are characterized in the dependent claims.

The invention is described in greater detail hereinafter relative to embodiments.

WAY TO PERFORM THE INVENTION

In FIG. 1 1 is a form sheet, which is e.g. made from paper, on which can be printed on one or two sides a random information, pattern, etc. 2 is a preferably rectangular piece of a support material, which comprises a support layer 21 and a peel glue layer 22. The support layer 21 is stuck to the back of the form by means of the peel glue layer 22.

Figure 1A:
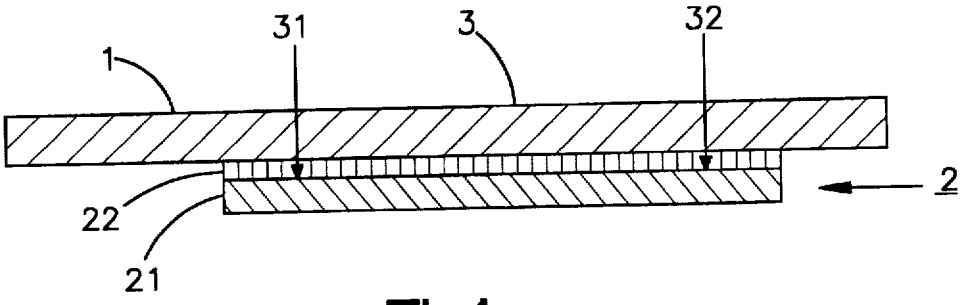
FIG. 1 is a sectional view under a) and b) of a first, simplest embodiment of a form sheet according to the invention.

As is indicated by the arrows in FIG. 1*a*), from the front of the form sheet 1 and within the surface of the support material 2 is performed a preferably all-round, i.e. bridge-free punching, which passes through the form sheet 1 and the peel glue layer 22 and extends down to the support layer 21. It is non-prejudicial if the support layer 21 is also punched to a certain extent, provided that it does not lose its supporting properties.

As a result of the said preferably all-round punching, from the form sheet 1 is cut a blank or a card 3, which has no longer any connection to the surrounding material of the sheet 1 and is merely held in the latter by the not punched support layer 21.

The peel glue of the layer 22 is so set or adjusted in known manner that the card 3 is on the one hand sufficiently securely and firmly held in the form sheet 1, i.e. is not prematurely peeled off during correct handling of said sheet 1 or also during its automatic processing, but on the other can be detached from said sheet 1. On detaching the card the peel glue 22 must entirely remain on the support layer 21. Thus, contrary to what occurs with self-adhesive labels, it must not be peeled off together with the card 3. Thus, the peel glue layer 21 has a permanent adhesive action with respect to the support material 21 and a non-permanent adhesive action with respect to the form sheet 1.

Figure 1B:
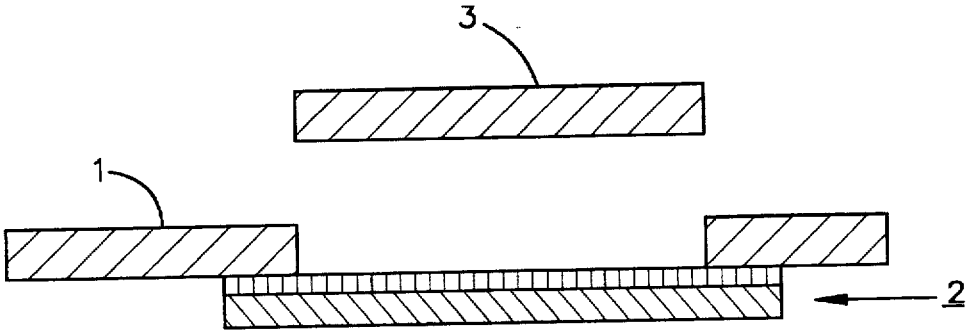

FIG. 1*b*) shows the form with the detached card 3. It is clear that the peel glue layer 22 has remained on the support layer 21 and has not "been carried along" with the card 3, so that the latter is not self-adhesive. Preferably the peel glue layer 22 is also adjusted in such a way that following the detachment of the card 3 it is no longer tacky or sticky.

A paper or film material can be used for the support layer 21 and, like the form, can carry an imprint or print impression. It can be transparent or opaque. In the latter case an imprint on the card-side surface of the support layer 22 and on the card back would initially be concealed and would only become visible on detaching the card 3.

All the embodiments described hereinafter are based on the aforementioned basic structure, so that a further description, thereof will not be given.

Figure 2A:
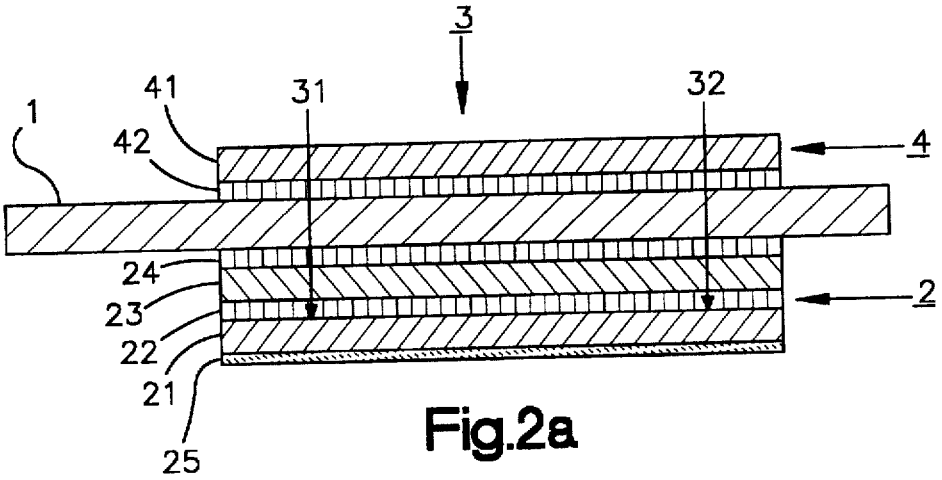
FIG. 2 is a sectional representation under a) and b) of an embodiment extended compared with the first embodiment by cover layers.
Figure 2B:
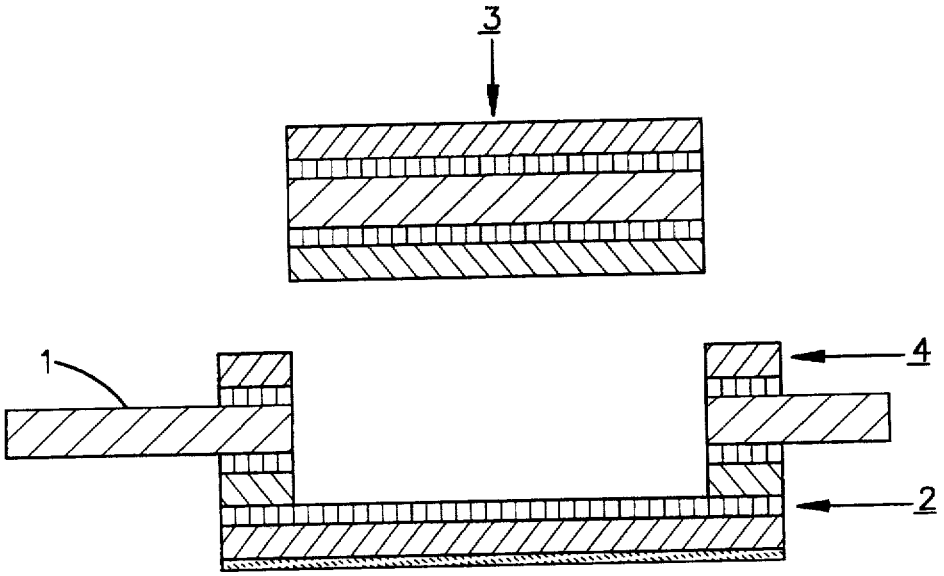

In the embodiment of FIG. 2 the back support material 2 has, in addition to a support layer 21 and a peel glue layer 22, a cover layer 23 and a permanent contact adhesive layer 24. On the front of the form is a preferably rectangular piece, like the support material 2, of a covering material 4, which also comprises a cover layer 41 and a permanent contact adhesive layer 42. The two cover layers 23 and 41 are preferably transparent plastic films, through which it is possible to see an eventual imprint on the form sheet 1 in the vicinity of the card 3. The cover layers also stiffen the card 3 and can also give it a water-repelling and abrasion-resistant surface.

Instead of being formed from a plastic film the cover layers 23 and 41 could also be made from a paper material with preferably similar characteristics, such as e.g. parchment paper. The use of a paper material for at least one of the two cover layers 2 or 4 offers the advantage that it would be possible to inscribe said cover layer. However, processes are also known (e.g. by the application of a dull or matt finish), with which it is possible to render smooth film surfaces inscribable.

It is obvious that as a function of the particular application only one of the two cover layers 23, 41 is provided, whereby preferably the cover layer 23 is used, because it is part of the support material 2 and the support layer 21, so that it is in any case necessary.

The support material 2 is preferably completely prefabricated and then applied as a whole to the form back. This is much more economic than the application in successive manner of the individual layers. The support material can in particular be supplied as an endless or continuous material in reel form to the form manufacturer by a specialized film manufacturer or finisher. As the top layer 24 is a permanent contact adhesive layer, special measures must be taken so that the support material 2 can be rolled onto itself. Such a measure is a back separating coating of the support layer, e.g. by means of a silicone application. Such an application is designated 25 in FIG. 2. Alternatively the support material 2 could initially be provided with an additional release or separating paper layer, but this would constitute waste at the time of form production.

Figure 3A:
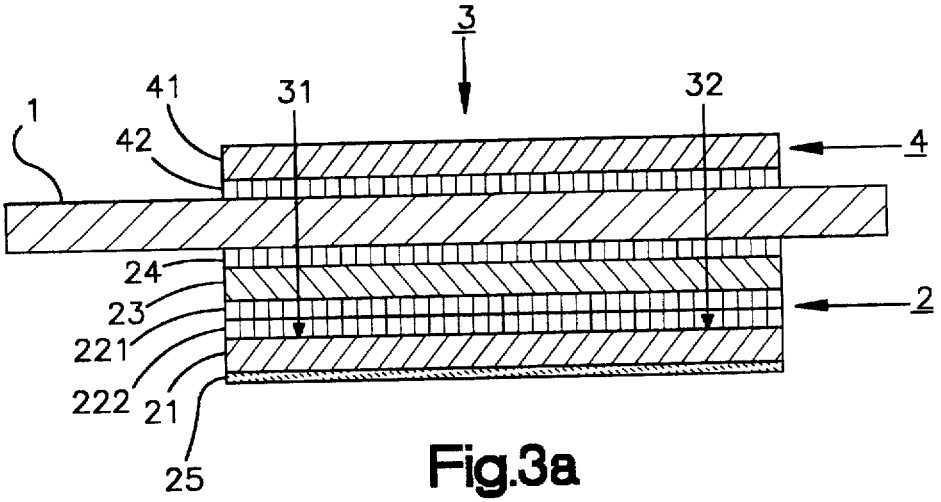
FIG. 3 a sectional representation under a) and b) of a further embodiment with a specially constructed peel glue layer.
Figure 3B:
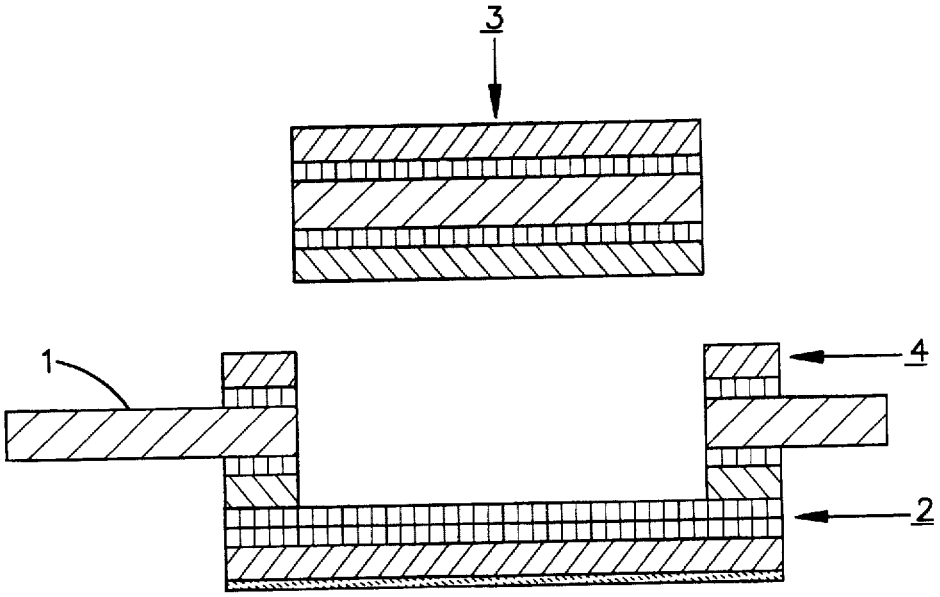

In FIG. 3 the peel glue layer 22 in the support material 2 is formed by a substantially identically behaving double layer of a first partial layer 221 and a second partial layer 222. Use is made for the first partial layer 211 of a non-permanent contact adhesive (with respect to the cover layer 23) or a peel glue (a peel glue is a special, non permanent contact adhesive) and for the second partial layer 222 a permanent contact adhesive (with respect to the support layer 21).

Such a double layer 221/222 is also used in the embodiment of FIG. 4. Additionally between the second, permanent contact adhesive layer 222 and the support layer 21 is provided a separating layer 26, e.g. a silicone treatment of the support layer 21. The two adhesive layers 221 and 222 are so set or adjusted that the adhesiveness of the layer 222 to the separating layer 26 is lower than the adhesiveness of the layer 221 to the cover layer 23. Thus, on detaching the card 3 the double layer accompanies the latter, as is shown in FIG. 4*b*). Then, the card 3, like a self-adhesive label, is self-adhesive and can be stuck again at another location, e.g. to another paper substrate 11, as is shown in FIG. 4*c*).

Figure 4A:
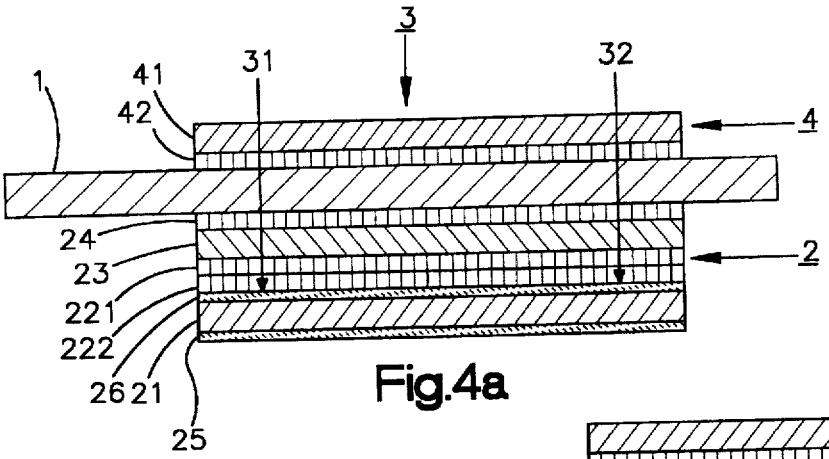
FIG. 4 a sectional representation under a) to d) of an embodiment in which the card is initially self-adhesive.
Figure 4B:
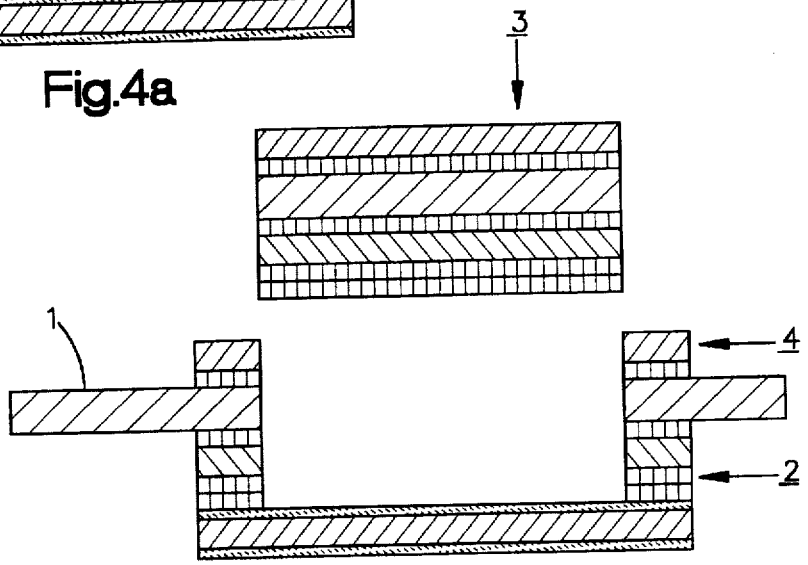
Figure 4C:
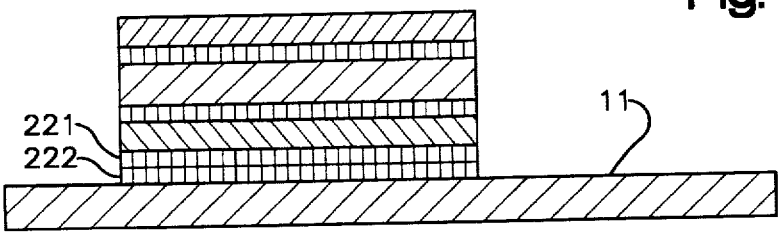
Figure 4D:
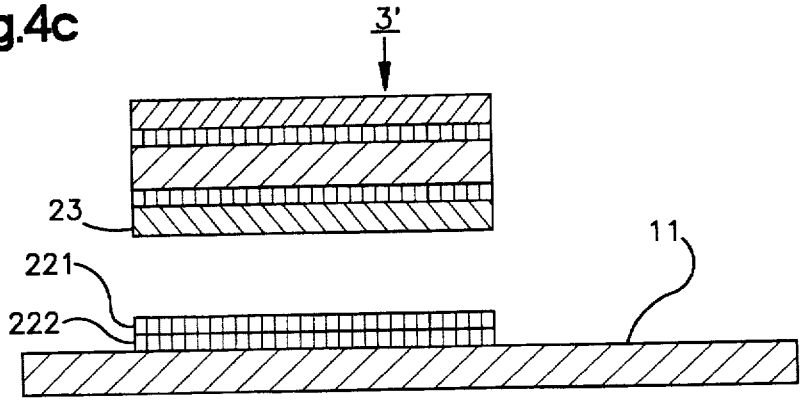
Figure 5A:
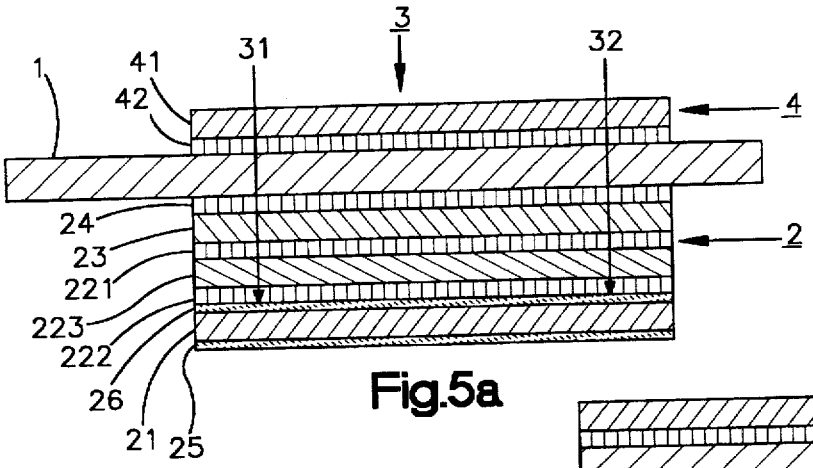
FIG. 5 a sectional representation under a) to d) of another embodiment with a self-adhesive card.
Figure 5B:
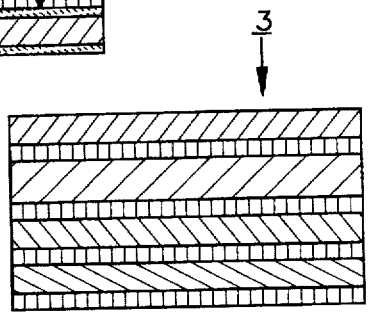
Figure 5B:
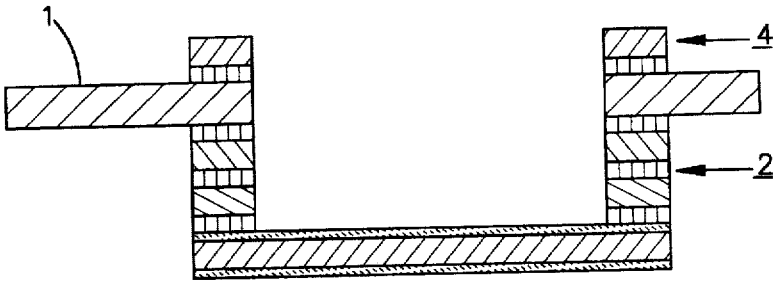
Figure 5C:
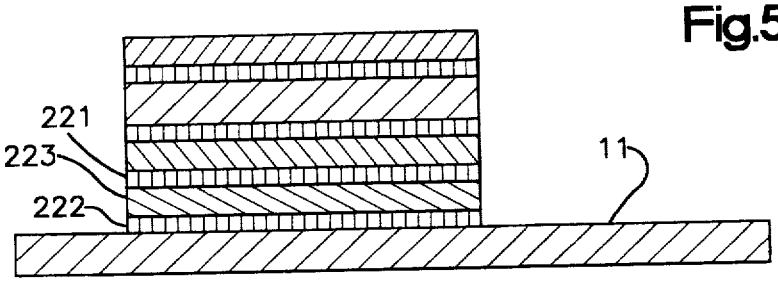
Figure 5D:
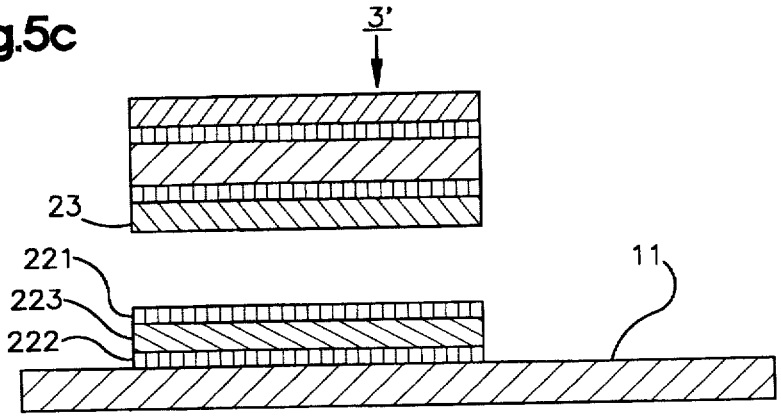

As a result of these characteristics of the double layer 221/222 it is subsequently still possible to redetach the card 3 as card 3' from its new support 11, as shown in FIG. 4*d*). As a result of the fact that a separating coating is generally absent on the new support 11 the contact adhesive of the partial layer 222 evolves a permanent adhesive action with respect to its surface which is greater than the non-permanent adhesive action between the first partial layer 221 and the cover layer 23. The separation now takes place on detaching the card 3' between the two latter layers. The double layer 221/222 is left behind on the new support 11, as shown in FIG. 4*d*).

The embodiment of FIG. 5 functionally corresponds to that of FIG. 4, except that there is an auxiliary support layer 223 between the two partial layers 221/222. Said layer 223 accompanies the card 3 when the latter is detached from the form sheet 1 (FIG. 5*b*)), but after resticking to a new support 11 (FIG. 5*c*)) and the subsequent redetachment therefrom passes back to the new support (FIG. 5*d*)). The solution with the auxiliary support layer 223 in place of only the two non-self-supporting layers 221, 222 can be advantageous from the manufacturing standpoint. A paper or film material, as for the remaining supporting layers, can be used for the auxiliary support layer 223.

Figure 6A:
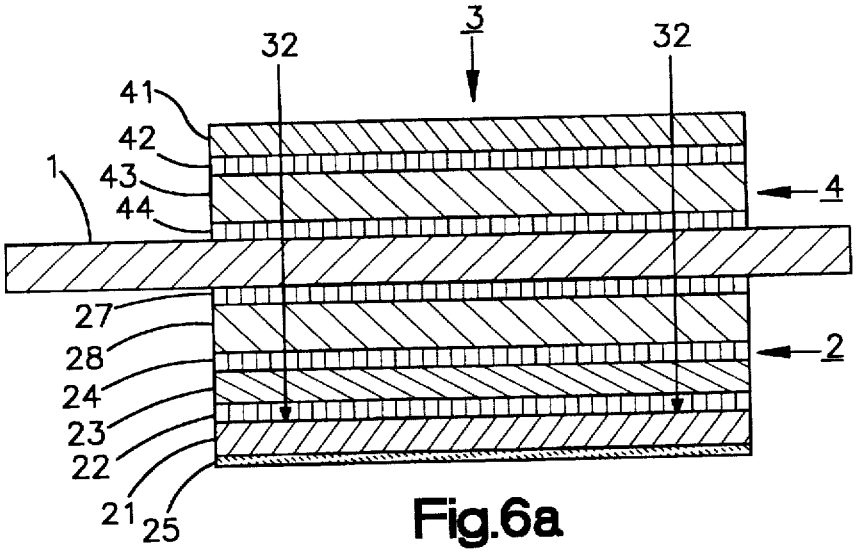
FIG. 6 a sectional representation under a) and b) of an embodiment with double layers of form material.
Figure 6B:
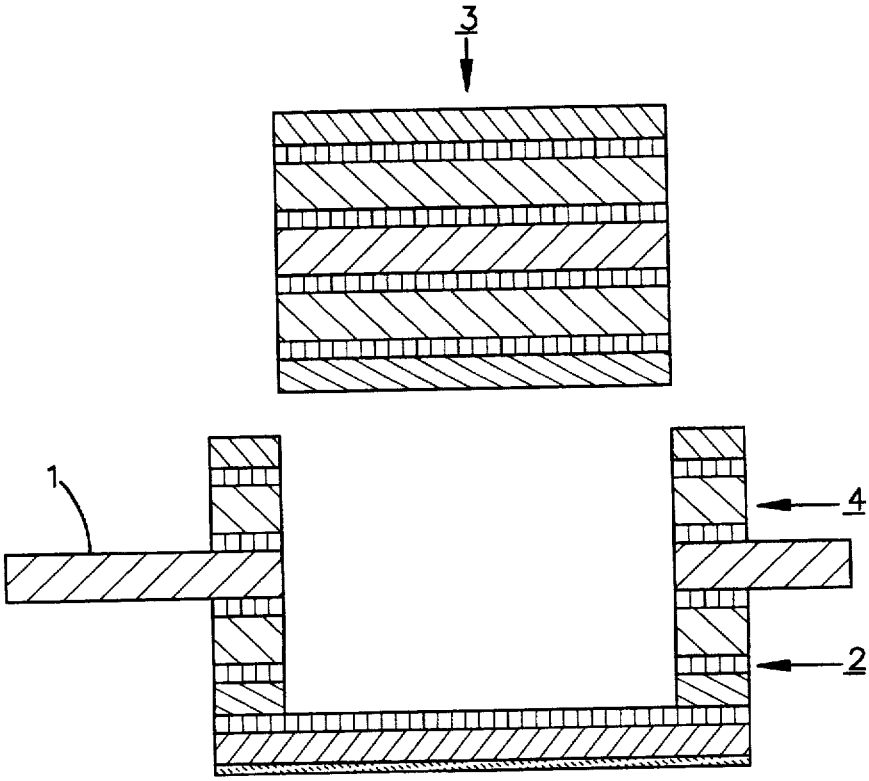

In FIG. 6 the layer structure of FIG. 2 in the support material 2 is increased by a self-supporting layer 27, as well as a permanent contact adhesive layer 28 and in the covering material 4 by a self-supporting layer 43 and a permanent contact adhesive layer 44. The additional layers 27 and 43 are used for further stiffening the card 3 and are advantageously made from the same material as the form sheet 1. They can naturally be printed in the same operation as the form sheet on an adjacent web, as shown in FIG. 7.

Figure 7:
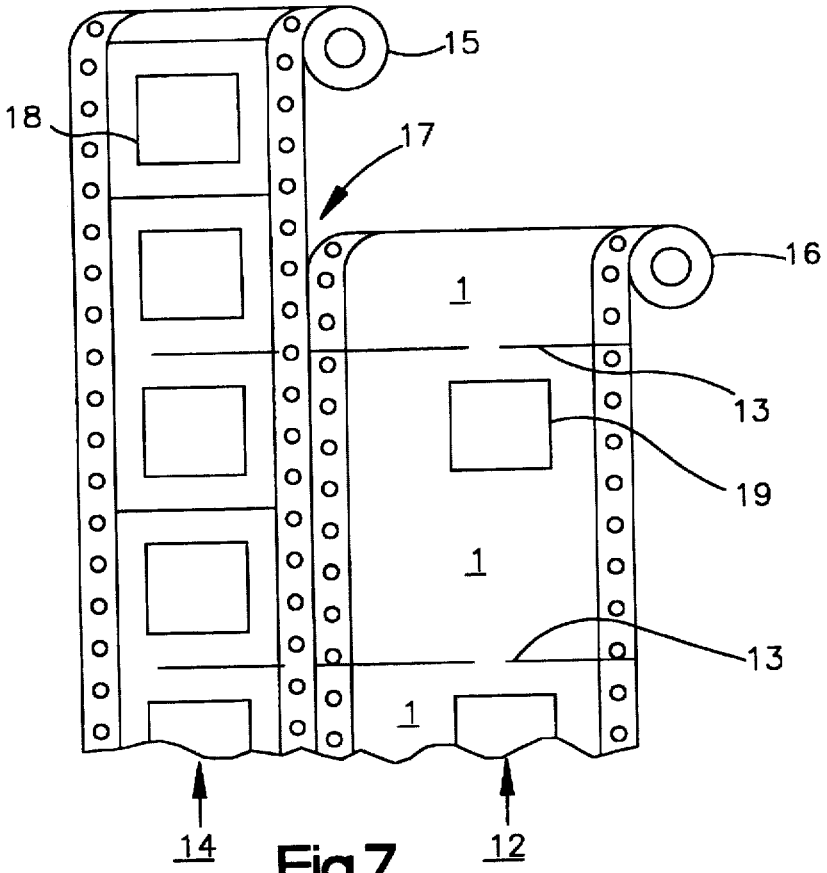
FIG. 7 in plan view and diagrammatically is shown how the form sheets and the double layers of the embodiment of FIG. 6 can be printed in the same operation.

FIG. 7 shows a continuous web 12 of already printed form sheets, which are linked by perforation lines 13. Laterally connected to the web 12 of form sheets 1 and jointly printed therewith is an adjacent web 14, which on the point indicated by the arrow 17 is separated from the main web 12 and wound onto a reel 15. The main web 12 is wound onto another reel 16. For each form sheet 1 in the main web 12 generally on the secondary web 14 are applied two print impressions or imprints with the size 1 required for the support material 2 and the covering material. One of these is shown with the reference numeral 18. An imprint of corresponding size on the form sheets 1 in the vicinity of the subsequent card is indicated at 19.

FIG. 8 uses a support material 2 like that of FIG. 2, but those of FIGS. 1, 3 or 6 could equally well be used. In the covering material 4 on the form front is additionally provided between a cover layer 41 and a permanent contact adhesive layer 42 a separating or relief layer 45. Thus, after detaching the card 3 and as shown in FIG. 8*c*), the cover layer 41 together with its separating coating 45 can be removed and the contact adhesive layer 42 exposed. The card 3' is then self-adhesive on its front and can, as shown in FIG. 8*d*), be stuck in the manner of a vignette, e.g. to a glass plate 17.

Also in the embodiment of FIG. 9 the support material 2 of FIG. 2 is used, but it would also be possible to use those of FIGS. 1, 3 or 6. The modification is once again on the front of the form where, under the covering material 4 corresponding to that of FIGS. 2 to 5 and incorporating a cover layer 41 and a permanent contact adhesive layer 42, is a further material 5 with a supporting layer 51 of paper or film and a separating coating 52 is inserted towards the contact adhesive layer 42 and which is subsequently referred to for short as the separating paper. The covering material 4 projects on either side over the separating paper 5, so that in both the resulting marginal zones 46, 47 there is a permanent bonding of the covering material 4 to the front of the form. Only for representational reasons is the thickness of the contact adhesive layer 42 in the said marginal zones shown in exaggerated form. In reality it is uniform and adapts the covering material to the separating paper. For the standard layer thicknesses this only constitutes a negligible step.

Figure 9A:
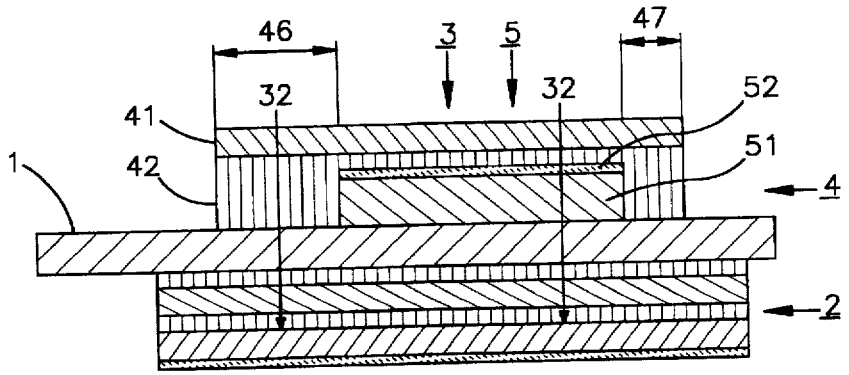
FIG. 9 is a sectional representation under a) and b) and d) to f), as well as in plan view under c) of an embodiment, in which the card can be folded and stuck together again after removing a separating layer.
Figure 9B:
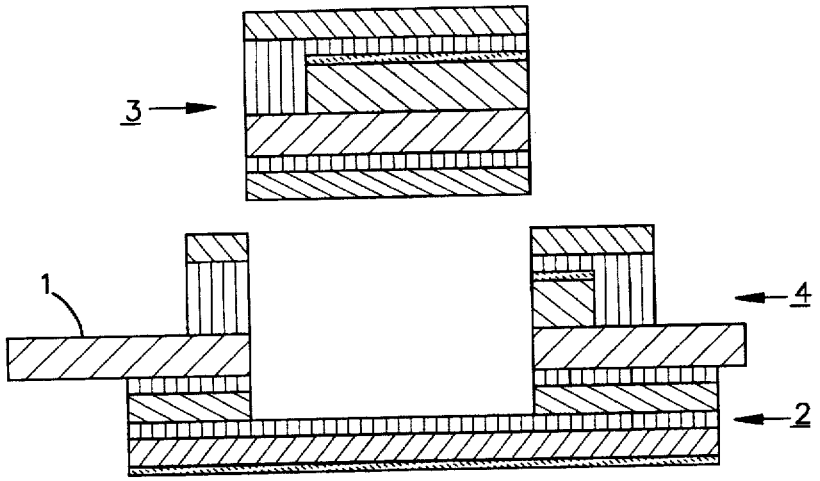
Figure 9C:
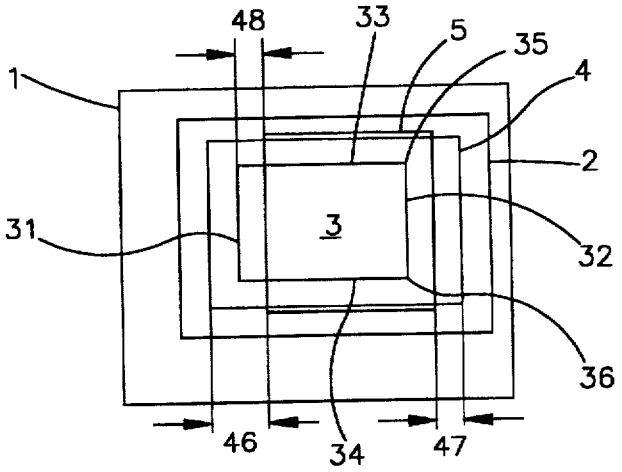

The punching for producing the card 3 is now performed in such a way that a punch line 31 is located in the marginal zone 46 and the other line 32 traverses the paper 5. The two remaining punch lines 33, 34 are so chosen that they are located in the overlap area of the covering material 4 with the separating paper 5. FIG. 9*c*) shows diagrammatically in a type of plan view the relative arrangement of the individual layers or materials, as well as the position of the card 3 fixed by said punch lines. FIG. 9 shows the material pieces 2, 4 and 5 with different sizes for illustration reasons. They could all have the same extent in the direction of the punch lines 31, 32. In the direction of the punch lines 33, 34 the support material 2 could be of the same size or smaller than the covering material.

Figure 9D:
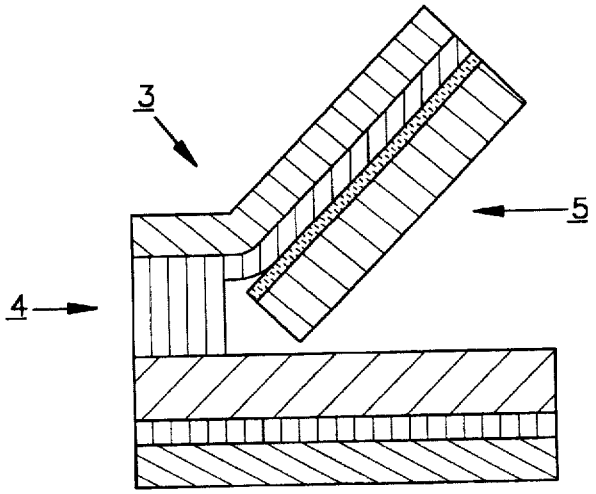
Figure 9E:
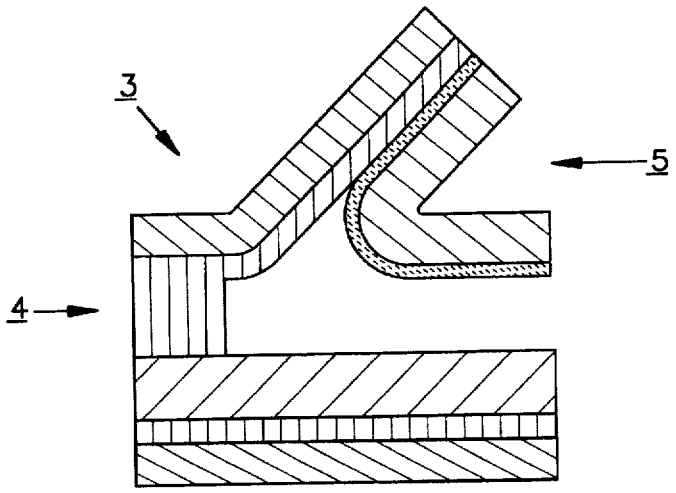
Figure 9F:
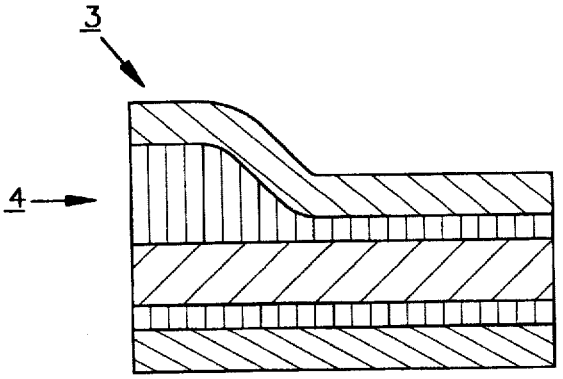

Following the detachment of the card 3 in the embodiment of FIG. 9 it is possible, as shown in FIG. 9*d*), due to the separating paper 5 to raise the covering material 4 from the card surface by bending up on one side. It merely firmly adheres thereto in the marginal zone 48. As a result of its preferably adequate inherent rigidity, as can be seen in FIG. 9*d*), the separating paper 5 is detached in the bending zone 49 from the covering material 4 and can therefore easily be gripped at this point and, as shown in FIG. 9*e*), removed. The covering material 4 can then be bonded in full-surface, durable manner to the card surface. The corresponding structure is shown in FIG. 9*f*), the thickening of the contact adhesive layer shown in the marginal zone 48 not existing in practice and, as explained, is only due to the illustration used here.

The embodiment of FIG. 9 is particularly advantageous if the cover layer 41 of the covering material 4 is transparent. With the card of FIG. 9 it is advantageously possible to make e.g. manually an individual inscription on the card surface and which following the removal of the separating paper 5 and the permanent bonding of the covering material 4 can be seen through the transparent cover layer 41, but is sealed and rendered inaccessible by the latter. It would also be possible to bond a passport photograph between the card surface and the covering material 4.

Although the punching for producing the card according to the present invention preferably takes place in all-round manner, i.e. without leaving punching bridges, in the embodiment of FIG. 9, e.g. at the points designated 35 and 36 in FIG. 9*c*), such webs could be left in punctiform manner in order to prevent the covering material 4 being prematurely raised from the card surface and consequently possibly causing problems when processing the form, particularly in laser printers.

Figure 10A:
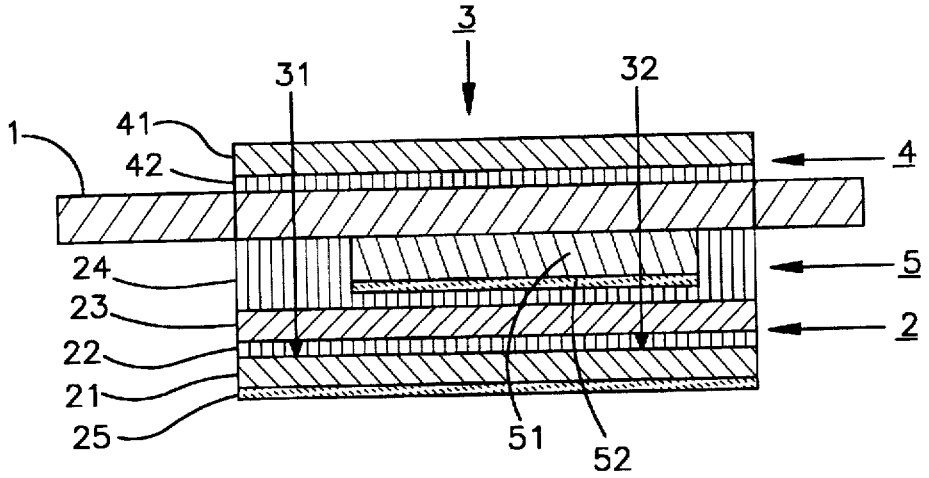
FIG. 10 is a sectional representation under a) and b) of an embodiment similar to FIG. 9.
Figure 10B:
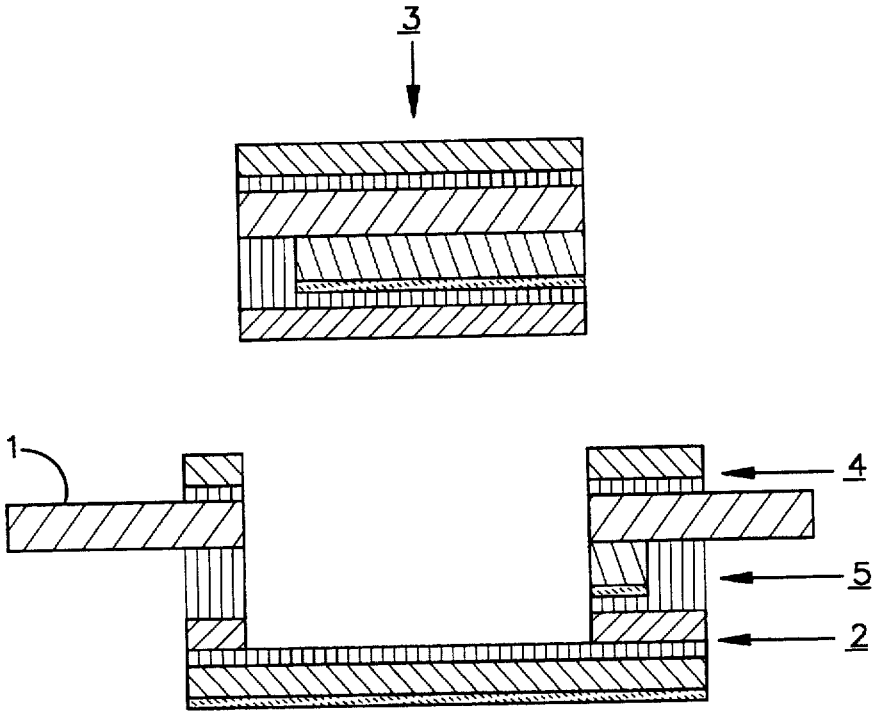

The embodiment of FIG. 10 functionally corresponds to that of FIG. 9, except that here a separating paper piece 5 is inserted between the card back and the support material 2. The resulting card 3 is obviously a mirror image of that of FIG. 9.

Figure 11A:
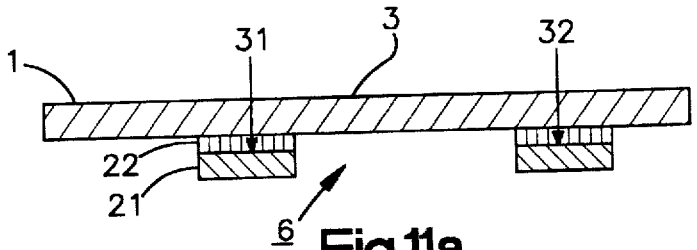
FIG. 11 is a sectional representation under a) and b) of an embodiment corresponding to FIG. 1, but with the card back punched free.
Figure 11B:
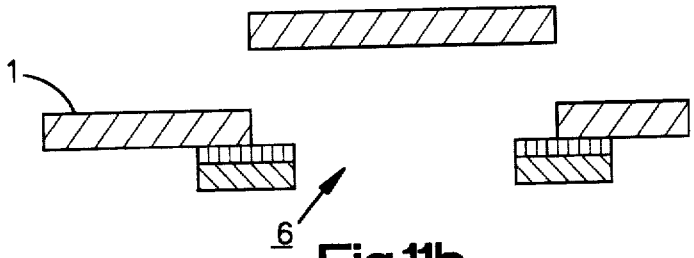

FIG. 11 shows an embodiment according to FIG. 1, but in which in the back support material 2 within the card area, i.e. within the punch lines 31, 32, there is an additional punching 6 (window or strip) and the blank is subsequently removed. Therefore the back of the card 3 is exposed in the window area and can advantageously e.g. be printed.

Figure 12A:
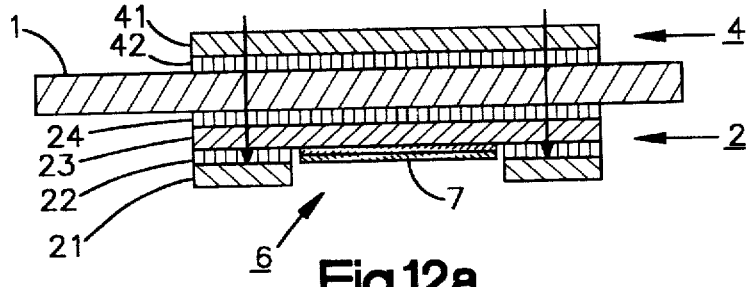
FIG. 12 is a sectional representation under a) and b) of an embodiment corresponding to FIG. 2, but with a punched out card back.
Figure 12B:
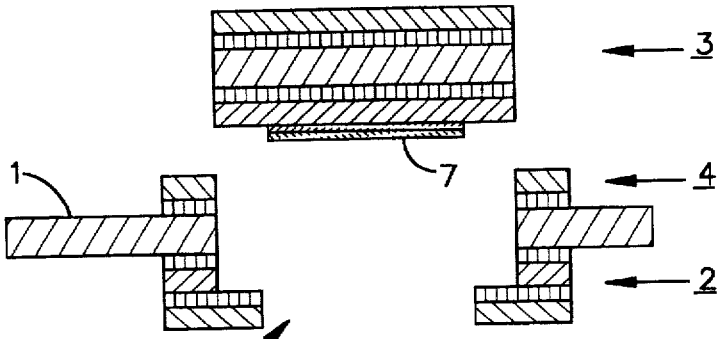

A corresponding punching 6 is made in FIG. 12. However, as otherwise the layer structure corresponds to that of FIG. 2, the punching 6 exposes the surface of the cover layer 23, which is preferably a film. In order to here ensure the printability or inscribability of the back of the card in the form sheet 1, it can be provided in the window area with a matt finish 7.

Figure 13:
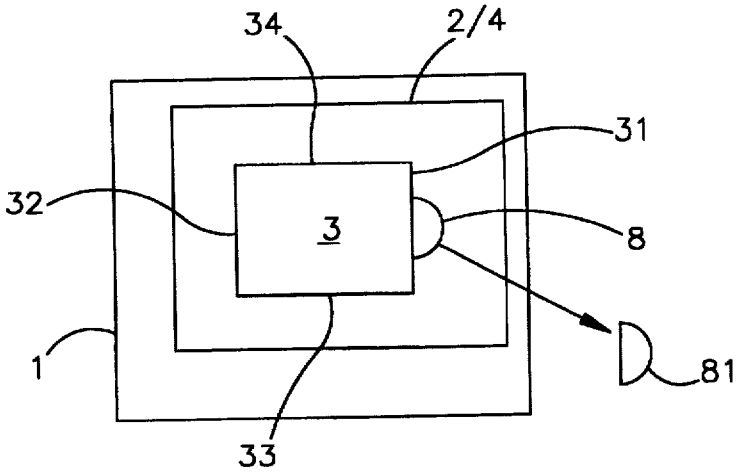
FIG. 13 is a plan view of an embodiment with a punching through which is formed a removal aid for the card.
Figure 8A:
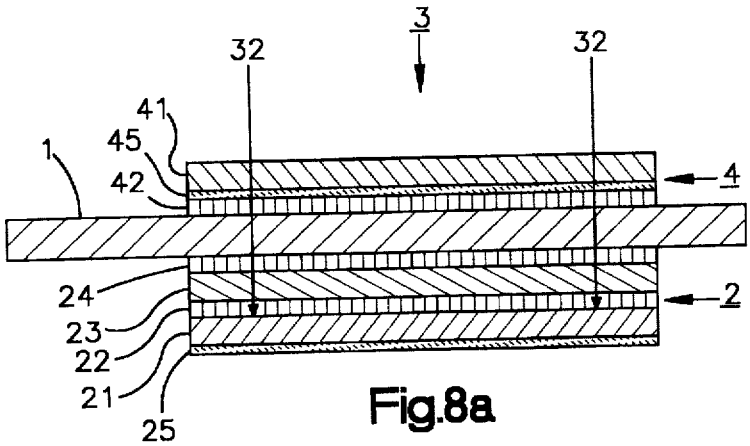
FIG. 8 is a sectional representation under a) to d) of an embodiment usable as a vignette.
Figure 8B:
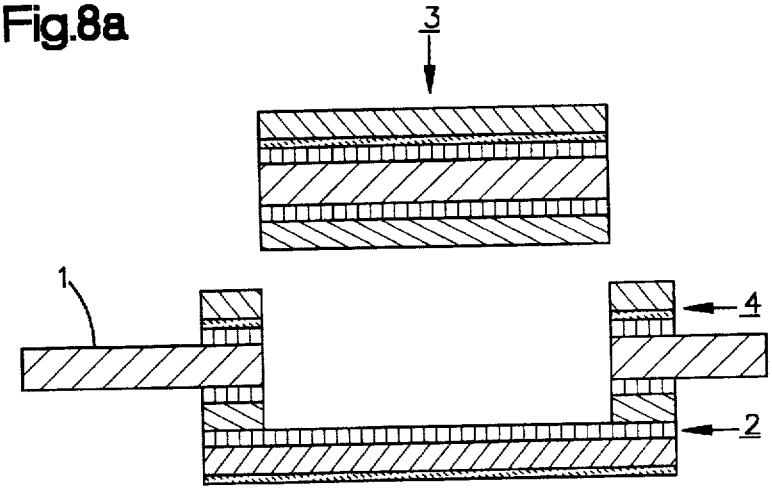
Figure 8C:
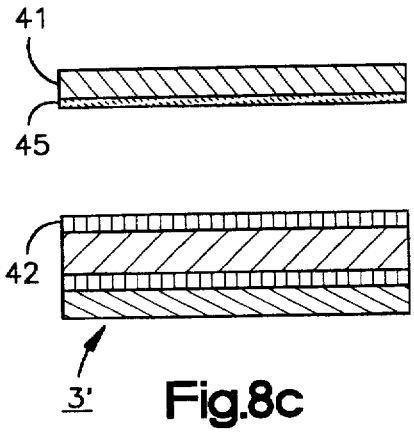
Figure 8D:
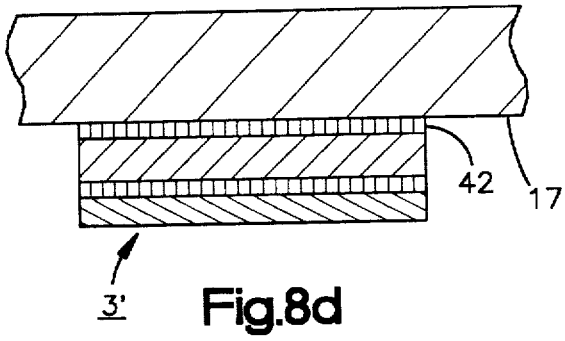

FIG. 13 finally shows in a plan view a semicircular punching 8, whose chord is formed by the punch line 32 and which is as deep as the remaining punchings 32 to 34. The resulting blank 81, whose layer structure coincides with the card 3, is removed from the form sheet 1, so that a practical removal aid for the card 3 is provided.

With respect to the support material 2 and FIG. 2, it has already been stated that it is preferably completely prefabricated in continuous form by a specialized manufacturer and is merely cut to length by the form manufacturer and dispensed on form sheets 1, preferably once again in a continuous process. This obviously also applies for the other variants of the support materials and for the covering materials 4.

I claim:

1. Form (1) with integrated, detachable card (3) and onto the back of the form, at least partly covering the area of the card (3), is stuck a support material (2), which besides a support layer (21) has a peel glue layer (22) with respect to the card (3), wherein the card (3) is a blank produced by punching performed from the front of the form and extending up to the support layer (22) and held in the form (1) by the support layer (21), the peel glue layer remaining entirely on the support layer and no longer being sticky after the card is detached from the form.

2. Form according to claim 1, wherein, considered in the punching direction, the support material (2) upstream of the peel glue layer (22) and the support layer (21), additionally has a first permanent contact adhesive layer (24) and a first cover layer (23).

3. Form (1) with integrated, detachable card (3) and onto the back of the form, at least partly covering the area of the card (3), is stuck a support material (2), which besides a support layer (21) has a peel glue layer (22) with respect to the card (3), wherein the card (3) is a blank produced by punching performed from the front of the form and extending up to the support layer (22) and held in the form (1) by the support layer (21), the peel glue layer remaining entirely on the support layer and no longer being sticky after the card is detached from the form;

wherein, considered in the punching direction, the support material (2) has as the final, outermost layer a first separating layer (25).

4. Form (1) with integrated, detachable card (3) and onto the back of the form, at least partly covering the area of the card (3), is stuck a support material (2), which besides a support layer (21) has a peel glue layer (22) with respect to the card (3), wherein the card (3) is a blank produced by punching performed from the front of the form and extending up to the support layer (22) and held in the form (1) by the support layer (21), the peel glue layer remaining entirely on the support layer and no longer being sticky after the card is detached from the form;

wherein, considered in the punching direction, the peel glue layer (22) comprises a first partial layer (221) with a non-permanent contact adhesive or a peel glue and a second partial layer (222) with a permanent contact adhesive.

5. Form according to claim 4, wherein there is also an auxiliary support layer (223) between the first (221) and the second (222) partial layer.

6. Form (1) with integrated, detachable card (3) and onto the back of the form, at least partly covering the area of the card (3), is stuck a support material (2), which besides a support layer (21) has a peel glue layer (22) with respect to the card (3), wherein the card (3) is a blank produced by punching performed from the front of the form and extending up to the support layer (22) and held in the form (1) by the support layer (21), the peel glue layer remaining entirely on the support layer and no longer being sticky after the card is detached from the form;

wherein between the peel glue layer (22) and the support layer (21), the support material (2) has a second separating layer (26).

7. Form according to claim 1, wherein, considered in the punching direction, upstream of the peel glue layer (22), the support layer (21) and optionally further layers (23, 24), the support material (2) has a second permanent contact adhesive layer (27), as well as a layer (28), which is preferably made from the form material.

8. Form according to claim 1, wherein on the form back between the latter and the support material (2) and only partly covering the area on the card (3), is inserted a material (5) with a separating coating (52) with respect to the support material (2).

9. Form according to claim 1, wherein within the area of the card (3), the support material (2) has a punching (6) performed from its back and extending up and through the peel glue layer (21).

10. Form according to claim 2, wherein a matt finish (7) is applied in the vicinity of the punching (6) on the back of the first cover layer (23).

11. Form according to claim 1, wherein on the form front, covering the vicinity of the card (3), is stuck a covering material (4) with a second cover layer (41), as well as a third permanent contact adhesive layer (42).

12. Form according to claim 1, wherein, considered in the punching direction upstream of the form front and behind optionally further layers, the covering material (4) has a layer (43), which is made from the form material, as well as a fourth permanent contact adhesive layer (44).

13. Form (1) with integrated, detachable card (3) and onto the back of the form, at least partly covering the area of the card (3), is stuck a support material (2), which besides a support layer (21) has a peel glue layer (22) with respect to the card (3), wherein the card (3) is a blank produced by punching performed from the front of the form and extending up to the support layer (22) and held in the form (1) by the support layer (21), the peel glue layer remaining entirely on the support layer and no longer being sticky after the card is detached from the form;

wherein on the form front, covering the vicinity of the card (3), is stuck a covering material (4) with a second cover layer (41), as well as a third permanent contact adhesive layer (42);

wherein, considered in the punching direction, the covering material (4) has between the second cover layer (41) and the third contact adhesive layer (42), a third separating layer (45).

14. Form (1) with integrated, detachable card (3) and onto the back of the form, at least partly covering the area of the card (3), is stuck a support material (2), which besides a support layer (21) has a peel glue layer (22) with respect to the card (3), wherein the card (3) is a blank produced by punching performed from the front of the form and extending up to the support layer (22) and held in the form (1) by the support layer (21), the peel glue layer remaining entirely on the support layer and no longer being sticky after the card is detached from the form;

wherein on the form front, covering the vicinity of the card (3), is stuck a covering material (4) with a second cover layer (41), as well as a third permanent contact adhesive layer (42);

wherein on the form front between the latter and the covering material (4) and only partly covering the vicinity of the card (3), a material (5) with a separating coating (52) with respect to the covering material is inserted.

15. Form according to claim 1, wherein the material for the form (1), the cover layer or layers (23, 41) and the support layer (21) and the layer (51) are provided with the separating coating (52) is paper or film.

16. Form according to claim 2, wherein the material for the cover layer or layers (23, 41) and/or the support layer (21) is transparent.

17. Form according to claim 1, wherein punching (31–34) takes place all round the periphery without leaving punching bridges.

18. Form according to claim 1, wherein for facilitating the detachment of the card (3), adjacent to the latter is punched out a blank (81) whose structure corresponds to the card and is removed from the form (1).

19. Support material (2) constructed according to claim 1.

20. Covering material (4) constructed according to claim 11.

21. Process for producing a form (1) with detachable card (3) according to claim 1, wherein on the back of the form sheet (1) is stuck a support material (2) with a peel glue layer (22) and a support layer (21) and subsequently from the front of the form and at least partly within the support material (2), a punching is performed up to the support layer (21).

22. Process according to claim 21 for producing a form (1) according to claim 11, wherein, prior to punching, onto the form front is stuck a covering material (4) and the punching is performed through this material.

23. Process according to claim 21 for producing a printed form, wherein the layer or layers (28, 43) preferably made from the form material is printed as an adjacent web (14) together with the form (1).

24. Form (1) with integrated, detachable card (3) and onto the back of the form, at least partly covering the area of the card (3), is stuck a support material (2), which besides a support layer (21) has a peel glue layer (22) with respect to the card (3), said card (3) being a blank produced by punching performed from the front of the form and extending up to the support layer (22) and held in the form (1) by the support layer (21), wherein, considered in the punching direction, the support material (2) has as the final, outermost layer a first separating layer (25).

25. An article comprising:

a form (1) having a integrated, detachable card (3) having a first area; and a support material (2) disposed on the back of the form and at least partly covering the first area of the card (3), the support material (2) comprising a support layer (21) and a peel glue layer (22);

a portion of the peel glue layer being between the support layer and the detachable card and securing the detachable card to the support layer;

the portion of the peel glue layer between the support layer and the detachable card remaining entirely on the support layer and no longer being sticky after the card is detached from the form.

* * * * *